US008378920B2

(12) United States Patent
Shlager et al.

(10) Patent No.: US 8,378,920 B2
(45) Date of Patent: Feb. 19, 2013

(54) ELECTRICALLY SMALL ANTENNA WITH WIDEBAND SWITCHABLE FREQUENCY CAPABILITY

(75) Inventors: Kurt L. Shlager, Sunnyvale, CA (US); Liang C. Chu, Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 723 days.

(21) Appl. No.: 12/542,674

(22) Filed: Aug. 17, 2009

(65) Prior Publication Data

US 2011/0037679 A1 Feb. 17, 2011

(51) Int. Cl.
*H01Q 1/36* (2006.01)

(52) U.S. Cl. ..... 343/895; 343/876

(58) Field of Classification Search ..... 343/876, 343/895

See application file for complete search history.

(56) References Cited

U.S. PATENT DOCUMENTS 4,270,128 A * 5/1981 Drewett ..... 343/702
4,924,238 A * 5/1990 Ploussios ..... 343/802
5,274,388 A * 12/1993 Ishizaki et al. ..... 343/725
6,249,262 B1 * 6/2001 Lee et al. ..... 343/895
6,433,755 B1 * 8/2002 Kuramoto ..... 343/895
7,176,840 B1 * 2/2007 Kelley ..... 343/745
7,260,424 B2 8/2007 Schmidt
2003/0174100 A1 * 9/2003 Ogawa et al. ..... 343/895

OTHER PUBLICATIONS

Philip M. Izdebski, et al., "Conformal Ingestible Capsule Antenna: A Novel Chandelier Meandered Design," IEEE Transactions on Antennas and Propagation, V. 57, No. 4, Apr. 2009.

Steven R. Best, "The Radiation Properties of Electrically Small Folded Spherical Helix Antennas." IEEE Transactions on Antennas and Propagation, vol. 52, No. 4, Apr. 2004.

Steven R. Sest, "Low Q Electrically Small Linear and EllipticalPolarized Spherical Dipole Antennas," IEEE Transactions on Antennas and Propagation, vol. 53, No. 3, Mar. 2005.

Harold A. Wheeler, "The Radiansohere Around a Small Antenna," Proceedings of the IRE, Aug. 1959, p. 1325-1331.

* cited by examiner

*Primary Examiner* — Tho G Phan

(74) *Attorney, Agent, or Firm* — McDermott Will & Emery LLP

(57) ABSTRACT

An electrically small antenna includes a first plurality of helical arms extending in one direction from a central portion of the antenna and a second plurality of helical arms extending from the central portion in a direction opposite from the direction of the first plurality of helical arms. A plurality of switches are coupled to control signal transmission and reception on the helical arms, each of the plurality of switches is coupled between a corresponding one of the first plurality of helical arms and the second plurality of helical arms.

18 Claims, 4 Drawing Sheets

Eight Arm Configurations

Twelve Arm Configurations

ELECTRICALLY SMALL ANTENNA WITH WIDEBAND SWITCHABLE FREQUENCY CAPABILITY

BACKGROUND

Typically, a resonant antenna is designed to operate when it is a half wavelength long, although in some instances a quarter wavelength design is sufficient. Antennas that are designed to operate at a tenth of a wavelength or less are typically termed electrically small. Most electrically small antennas (ESA) exhibit high impedance mismatch and low efficiency. Furthermore, the few ESA designs which have been developed to date are inherently very narrowband, due to the limited volume that these ESAs occupy.

Electrically small antennas exhibit poor efficiency because their driving point impedance is inherently quite capacitive. Typically, antenna developers electrically enlarge these antennas by transforming a small dipole into a lengthy coil and thereby create a large inductance to cancel the capacitive reactance of the electrically short dipole. Furthermore, two and four arm folded spherical helixes can be used to increase the very low driving point resistance of the antenna, so as to match to the characteristic impedance of the feeding transmission line to allow for efficient radiation of the ESA; such antennas remain extremely narrow band.

SUMMARY

In some embodiments, an electrically small antenna system includes a first plurality of helical arms extending in one direction from a central portion of the antenna, a second plurality of helical arms extending from the central portion in a direction opposite from the direction of the first plurality of helical arms, and a plurality of switches coupled to control signal transmission and reception on the helical arms. Each of the plurality of switches is coupled between a corresponding one of the first plurality of helical arms and the second plurality of helical arms.

In other embodiments, a method of varying operational frequencies of an electrically small antenna system includes changing combinations of a plurality switches that are opened and closed. Different combinations of the switches correspond to different frequencies. The switches are coupled to control signal transmission and reception on helical antenna arms. One of the plurality of switches is coupled between one of a first plurality of helical arms and a second one of a plurality of helical arms.

BRIEF DESCRIPTION OF THE DRAWINGS

Embodiments disclosed herein may be better understood, and their numerous objects, features, and advantages made apparent to those skilled in the art by referencing the accompanying drawings. The use of the same reference symbols in different drawings indicates similar or identical items.

DETAILED DESCRIPTION OF THE FIGURES

Figure 1:
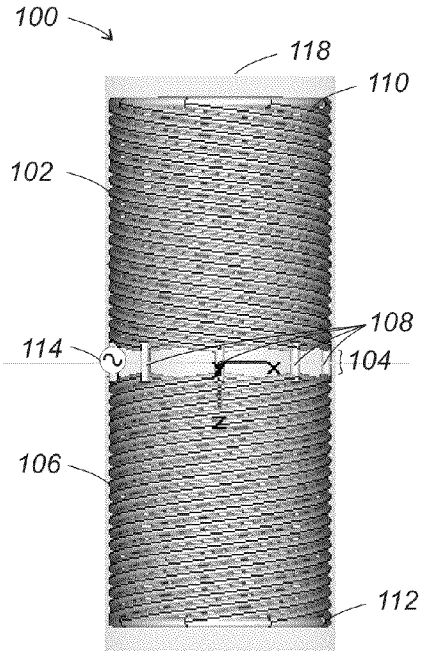
FIG. 1 is a cut-away diagram of a side view of an embodiment of an electrically small folded dipole antenna system showing multiple helical arms.
Figure 2:
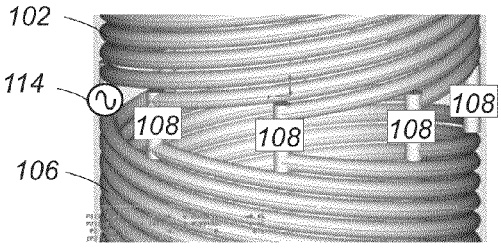
FIG. 2 is a diagram of a center portion of the embodiment of the antenna system of FIG. 1 including a feed point and switches coupled to the helical arms.

FIG. 1 is a diagram of a side view of an embodiment of a multi-armed folded helical electrically small antenna (ESA) dipole antenna system 100 that includes a first plurality of helical arms 102 extending in one direction from a central portion 104 of antenna system 100. A second plurality of helical arms 106 extends from central portion 104 in a direction opposite the direction of the first plurality of helical arms 102. A plurality of switches 108 are coupled at central portion 104 between a corresponding one of first helical arms 102 and second helical arms 106 to control signal transmission and reception on respective helical arms 102, 106, as shown in greater detail in FIG. 2. Switches 108 enable antenna system 100 to be reconfigured for different frequencies and bandwidths of interest, thereby significantly increasing the radiation efficiency of the antenna over a greater dynamic frequency range over known ESAs.

Switches 108 can be implemented using any suitable switch technology that can be operated via computer control. In some embodiments, switches 108 are micro-electro-mechanical systems (MEMS) switches that can be integrated into antenna system 100 by companies such as Radant MEMs of Stow, Mass.; Matsushita Electric Works, Ltd. of Osaka, Japan; Advantest America Corporation of Santa Clara, Calif.; XCOMwireless of Signal Hill, Calif.; MEMtronics Corporation of Plano, Tex.; or Wispry, Inc. of Irvine, Calif.; among others.

Figure 3:
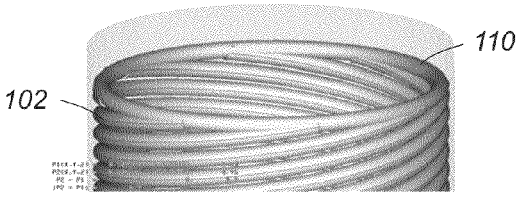
FIG. 3 is a diagram of an end portion of the embodiment of the antenna system of FIG. 1.

Antenna system 100 further includes first and second circular end portions 110, 112, as shown in greater detail in FIG. 3. One end of first helical arms 102 is coupled to first circular end portion 110 and one end of second helical arms 106 is coupled to the second circular end portion 112. The other ends of first and second helical arms 102, 106 are coupled to respective switches 108. End portions 110, 112 raise resonant feed resistance of antenna system 100 and enable antenna system 100 to work electrically. The inclusion of end portions 110, 112 is typically what terms the antenna as a "folded" type. Arms 102, 106 are made of a metallic material, such as copper, silver, or gold, for example. In some implementations, arms 102, 106 are mounted on a circuit board, where the board is wrapped around into a cylinder with seams of arms 102, 106 being matched. The thicknesses of arms 102, 106 are chosen such that there is maximum length of the arms used, without one adjacent arm touching another neighboring arm. Additionally, arms 102, 106 fit within a specified location or space, such as a capsule, which may or may not be in a pill like shape, or any other specified device. Note that arms 102, 106 turn approximately 2.5 times along their length.

An end of one of first helical arms 102 and an end of one of second helical arms 106 are coupled to feed point 114. In some embodiments, the nominal input/output impedance at feed point 114 is 50 ohms. Antenna system 100 can be configured for other feed point impedances, however.

Figure 4:
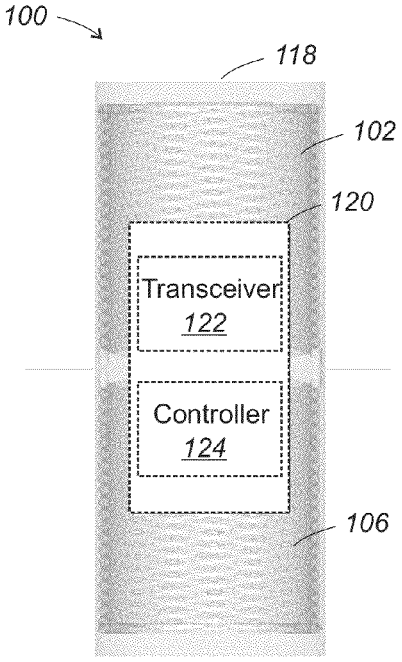
FIG. 4 is a cross-sectional diagram of the antenna system of FIG. 1 showing an electronics canister, which includes a transceiver and other electronics.

Antenna system 100 can further include protective shell or capsule 118 around the outer periphery of helical arms 102, 106, as shown in cutaway in FIG. 1 and in full in FIG. 4. Electronics canister 120 can be included in a hollow inner portion of antenna system 100 formed by helical arms 102, 106 and center portion 104. Switches 108 can be spaced around the circumference of a central portion 104 of the cylinder. Capsule 118 or other suitable structure can be sealed to protect contents of electronics canister 120 from water and contaminants.

Helical arms 102, 106 act as inductive coils to cancel the capacitive reactance of a short dipole antenna. A multi-arm folded configuration for antenna system 100 raises the low driving point impedance of antenna system 100. Switches 108 provide capability to vary the frequency of antenna system 100 over a relatively wide bandwidth. The length of arms 102, 106, the number of turns in the arms 102, 106, and the allowable width of the arms 102, 106 can be selected based on the dimensions of canister 120 and capsule 118, impedance required for antenna system 100, the dielectric constant of capsule 118, and the nominal design frequency for antenna system 100. Additionally, the desired switchable frequency capability determines the number of arms 102, 106 needed and the possible switchable configurations. Wider switchable frequency capabilities require larger number of arms. Note that in some instances, different switch configurations may lead to the same frequency of operation. Other relevant factors may be considered in the design of antenna system 100.

In some embodiments, electronics canister 120 can include transceiver 122 and computerized controller 124. Controller 124 can be coupled to open and close the switches 108 independently of one another. Controller 124 can also change transmit and receive frequencies across multiple frequency bands by changing the switches that are open and closed. The various functions, processes, methods, and operations performed or executed by antenna system 100 can be implemented as programs that are executable on various types of processing units such as controller 124, microprocessors, digital signal processors, state machines, programmable logic arrays, and the like.

Programs or logical instructions can be stored on any computer-readable medium or memory device for use by or in connection with any computer-related system such as controller 124 or method. A computer-readable medium is an electronic, magnetic, optical, or other physical memory device or means that can contain or store a computer program such as a program or logical instructions for use by or in connection with antenna system 100, method, process, or procedure. A computer readable medium may be found in antenna system 100. Programs can be embodied in logic instructions that are executed by a computer-readable medium for use by or in connection with an instruction execution system, device, component, element, or apparatus, such as a system based on a computer or processor, or other system that can fetch instructions from an instruction memory or storage of any appropriate type. Logic instructions can be implemented using any suitable combination of hardware, software, and/or firmware, such as microprocessors, Field Programmable Gate Arrays (FPGAs), Application Specific Integrated Circuits (ASICs), or other suitable devices.

Antenna system 100 can be configured to communicate with a variety of different devices for a variety of purposes. One example of a device capable of communicating with antenna system 100 is a search platform described in U.S. patent application Ser. No. 12/270,733 entitled "Systems, Apparatus, and Method for Providing and Detecting Information Regarding a Person, Location, or Object", which is incorporated herein by reference.

The term "capsule" as used herein may also refer to devices having form factors other than a pill-shape, such as a card, badge, or skin patch. Components used in antenna system 100 may thus be configured to fit in a pill-sized object, an identification card, a skin patch, or other apparatus. A card may be similar to an identification card assigned to individuals, or may be affixed to an article of clothing, pen, computer, pager or personal digital assistant ("PDA") or other items routinely worn or carried by an individual. Antenna system 100 can also be small enough to fit in or on disguise packaging such as pens, toothpaste tubes, fake lug nuts, jewelry, screws and other fasteners, rocks, simulated tree bark and plants, animals, insects, birds, building materials, equipment, ordinance, and shipping crates/boxes, among others. Antenna system 100 may be encased in anti-tamper packaging, coatings, or other suitable technique/structure to help prevent reverse engineering and physical dissection. Additionally, encrypted logic may be used for signals between components of capsule 118 to protect against reverse engineering and physical probing of active components.

Two multi-armed configurations, one with eight arms and the other with twelve arms, with particular application to U.S. patent application Ser. No. 12/270,733 are now described in detail. Nominally, for the 8-arm configuration, arms 102, 106 can have a 9 mil radius, while for the 12-arm configuration, arms 102, 106 can have a 5 mil radius. In some embodiments, antenna system 100 has a maximum 0.4 inch external diameter, and a maximum 1.0 inch length.

Figure 5:
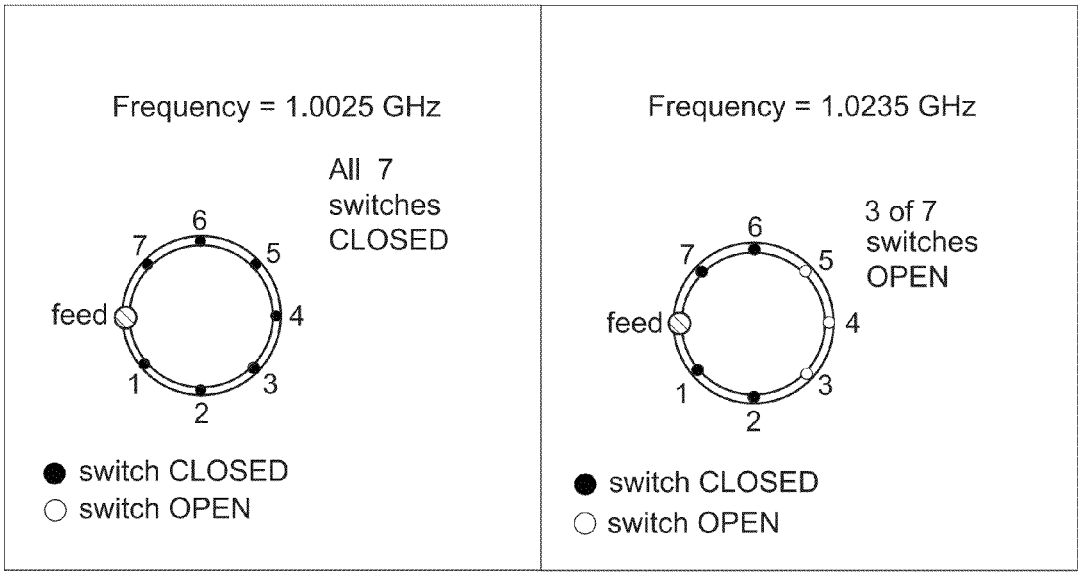
FIG. 5 shows diagrams of top views of the center portion of the embodiment of the antenna system of FIG. 1 with different configurations of 7 switches on the antenna arms in an eight arm configuration.

FIG. 5 shows examples of two different switch configurations of antenna system 100 with seven (7) switches 108 that achieve a maximum frequency spread of operation greater than 20 Mega-Hertz (MHz). The two configurations, shown with different switches open and closed, allow for the maximum operational frequency spread, each providing a matched 50 ohm impedance at its frequency of operation. At the lowest frequency, 1.0025 GHz, a 50 Ohm feed port 114 is utilized and all seven switches 108 are closed. At the highest frequency 1.0235 GHz, a 50 Ohm feed port 114 is utilized, three of seven switches 108 are open and four of switches 108 are closed. Antenna system 100 can operate at 9 different frequencies ranging from 1.0025 GigaHertz (GHz) to 1.0235 GHz, with typical center frequency separations of 1.5 MHz.

Table 1 shows various switch configurations and resulting frequencies for the embodiment of antenna system 100 of FIG. 5 with 8 pairs of arms 102, 106 and seven switches 108. (The number 1 indicates the corresponding switch is closed and number 0 represents the switch is open.)

TABLE 1

| Center | | Switch Number | | | | | | | Impedance |
|---|---|---|---|---|---|---|---|---|---|
| Frequency | Config | 1 | 2 | 3 | 4 | 5 | 6 | 7 | Bandwidth |
| 1.0025 | 1 | 1 | 1 | 1 | 1 | 1 | 1 | 1 | 1.6 MHz |
| 1.0055 | 2 | 1 | 1 | 1 | 0 | 1 | 1 | 1 | 2.0 MHz |
| 1.0070 | 3 | 1 | 1 | 0 | 1 | 0 | 1 | 1 | 2.0 MHz |
| 1.0100 | 4 | 1 | 0 | 1 | 0 | 1 | 0 | 1 | 1.7 MHz |
| 1.0115 | 5 | 1 | 1 | 0 | 0 | 1 | 1 | 1 | 1.9 MHz |
| 1.0130 | 6 | 1 | 1 | 0 | 0 | 1 | 0 | 1 | 1.7 MHz |
| 1.0143 | 7 | 1 | 0 | 0 | 1 | 1 | 1 | 1 | 1.9 MHz |
| 1.0160 | 10 | 1 | 0 | 0 | 1 | 1 | 0 | 1 | 1.5 MHz |
| 1.0235 | 11 | 1 | 1 | 0 | 0 | 0 | 1 | 1 | 1.4 MHz |

The switches being opened or closed change the effective length of the arms, thereby changing the impedance of the structure at a particular frequency. These changes cause the antenna to be matched to 50 ohms at slightly different frequencies, providing the dynamic bandwidth.

Figure 6:
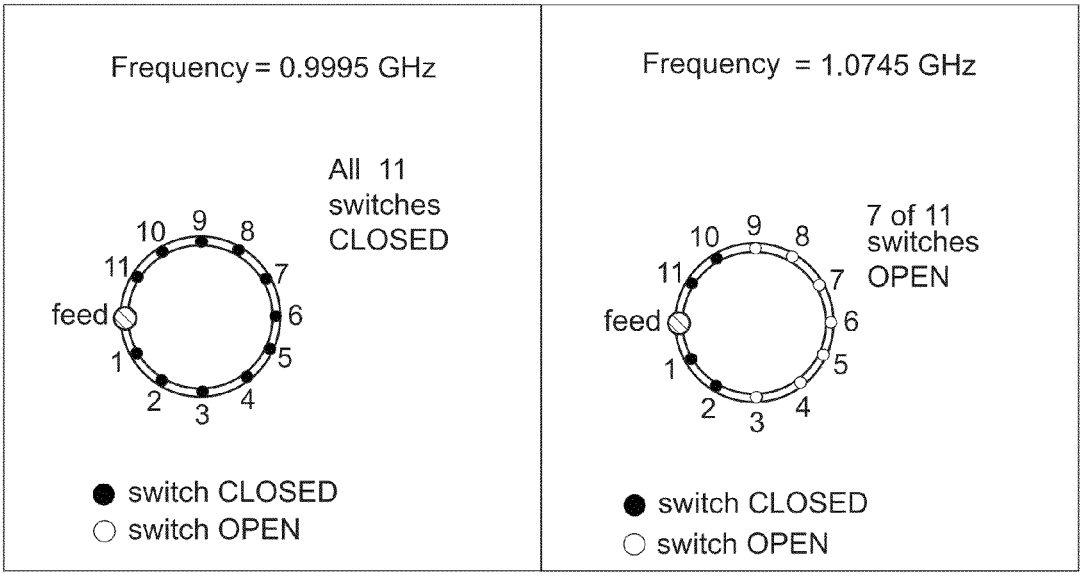
FIG. 6 shows diagrams of top views of the center portion of the embodiment of the antenna system of FIG. 1 with different configurations of 11 switches on the antenna arms in a twelve arm configuration.

FIG. 6 shows examples of two different configurations of antenna system 100 with eleven (11) switches 108 that achieve a maximum frequency spread of 75 MegaHertz (MHz), and an expanded number of operational frequencies compared to a configuration of antenna system 100 with seven switches 108. The two configurations, shown with different switches open and closed, allow for the maximum operational frequency spread, each providing a matched 50 ohm impedance at its frequency of operation.

Table 2 shows various switch configurations and resulting frequencies for another embodiment of antenna system 100 of FIG. 6 with 12 arms and 11 switches. (The number 1 indicates the corresponding switch is closed and number 0 represents the switch is open.) At the lowest frequency of 0.9995 GHz, all eleven switches 108 are closed with the twelfth arm 114 utilizing a 50 Ohm feed. At the highest frequency of 1.0745 GHz, seven of the eleven switches 108 are open, four of the switches 108 are closed, and the twelfth arm 114 utilizes a 50 Ohm feed. Antenna system 100 can operate at 10 different frequencies ranging from 0.9995 GHz to 1.0745 GHz, with a minimum center frequency separation of 1.5 MHz.

Note that other configurations of antenna system 100 with different numbers of arms 102, 106 and switches 108 can be used.

Figure 8A:
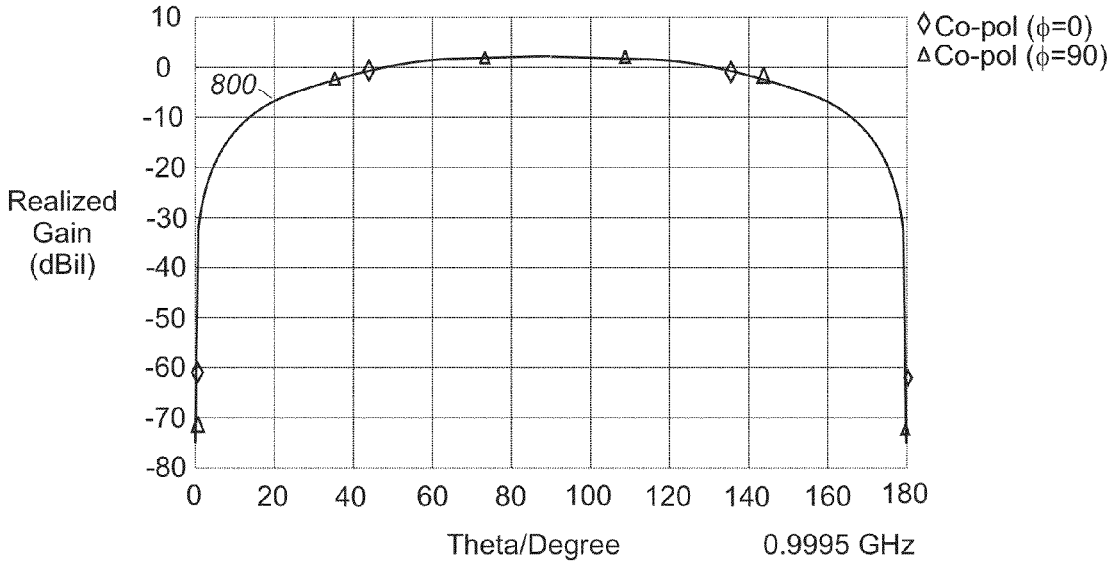
FIG. 8A shows a graph of realized gain for the embodiment of the antenna system of FIG. 6 with switches closed on all of the arms at a frequency of 0.9995 GHz.
Figure 8B:
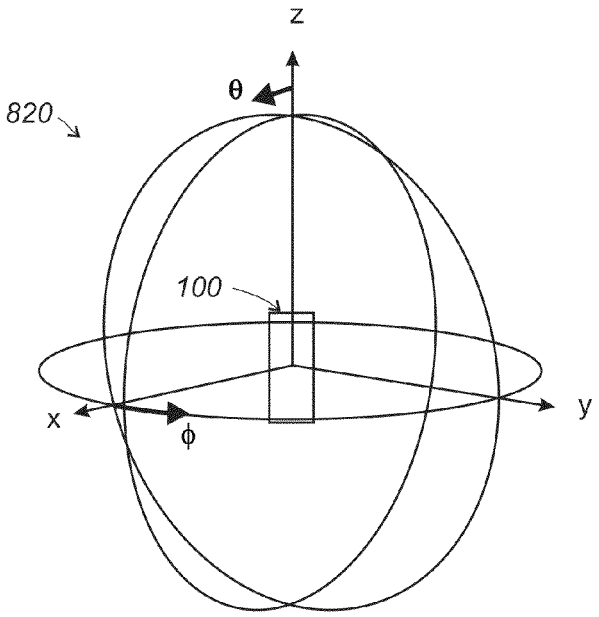
FIG. 8B shows a coordinate system used for the realized gain graph of FIG. 8A.

FIG. 8A shows graph 800 of realized gain for the embodiment of a nominal 1 GHz antenna system of FIG. 6 with switches closed on all of the arms. FIG. 8B shows a coordinate system 820 used for the realized gain graph 800 of FIG. 8A including Cartesian x, y, and z-axes, with spherical angles theta (θ) and phi (ϕ) defined. Graph 800 shows co-polarization realized gain versus angle theta (θ) around 180 degrees of the y-axis of antenna system 100, as shown in FIG. 8B, for angles of phi (ϕ) about the x-axis of antenna system 100 at zero (θ) to ninety (90) degrees. Graph 800 shows realized gain greater than approximately −10 decibels from theta of 14 to 166 degrees regardless of the angle (θ) about the x-axis.

While the present disclosure describes various embodiments, these embodiments are to be understood as illustrative and do not limit the claim scope. Many variations, modifications, additions and improvements of the described embodiments are possible. For example, those having ordinary skill in the art will readily implement the processes necessary to provide the structures and methods disclosed herein. Variations and modifications of the embodiments disclosed herein may also be made while remaining within the scope of the following claims. The functionality and combinations of functionality of the individual modules can be any appropriate functionality. Additionally, limitations set forth in publications incorporated by reference herein are not intended to limit the scope of the claims. In the claims, unless otherwise indicated the article "a" is to refer to "one or more than one".

TABLE 2

| | | Switch Number | | | | | | | | | | | |
|---|---|---|---|---|---|---|---|---|---|---|---|---|---|
| Center Frequency | Config | 1 | 2 | 3 | 4 | 5 | 6 | 7 | 8 | 9 | 10 | 11 | BW |
| 0.9995 | 1 | 1 | 1 | 1 | 1 | 1 | 1 | 1 | 1 | 1 | 1 | 1 | 1.5 MHz |
| 1.0010 | 2 | 1 | 1 | 1 | 1 | 1 | 0 | 1 | 1 | 1 | 1 | 1 | 1.4 MHz |
| 1.0025 | 3 | 1 | 1 | 1 | 1 | 1 | 0 | 1 | 1 | 1 | 1 | 1 | 1.4 MHz |
| 1.0055 | 4 | 1 | 1 | 0 | 1 | 0 | 1 | 0 | 1 | 0 | 1 | 1 | 1.5 MHz |
| 1.0070 | 6 | 1 | 0 | 1 | 1 | 1 | 1 | 1 | 1 | 1 | 0 | 1 | 1.3 MHz |
| 1.0115 | 7 | 1 | 1 | 1 | 0 | 0 | 1 | 0 | 0 | 1 | 1 | 1 | 1.3 MHz |
| 1.0145 | 8 | 1 | 1 | 1 | 1 | 0 | 0 | 0 | 1 | 1 | 1 | 1 | 1.3 MHz |
| 1.0175 | 9 | 1 | 1 | 0 | 1 | 0 | 0 | 0 | 1 | 1 | 1 | 1 | 1.0 MHz |
| 1.0445 | 10 | 1 | 1 | 1 | 0 | 0 | 0 | 0 | 0 | 1 | 1 | 1 | 0.6 MHz |
| 1.0745 | 11 | 1 | 1 | 0 | 0 | 0 | 0 | 0 | 0 | 0 | 1 | 1 | 0.0 MHz |

During operation, an embodiment of a method of varying operational frequencies of electrically small antenna system 100 includes changing combinations of switches 108 (FIGS. 1, 5, 6) that are opened and closed. Different combinations of switches 108 correspond to different antenna system operational frequencies. Switches 108 are coupled to control signal transmission and reception on helical antenna arms 102, 106. Switches 108 are coupled between pairs of one of a first plurality of helical arms 102 and one of a plurality of helical arms 106. One of the first helical arms 102 and one of the second helical arms 106 are coupled to electrical feed 114. Switches 108 can be opened and closed independently of one another via logic instructions in automated controller 124 (FIG. 4).

Figure 7:
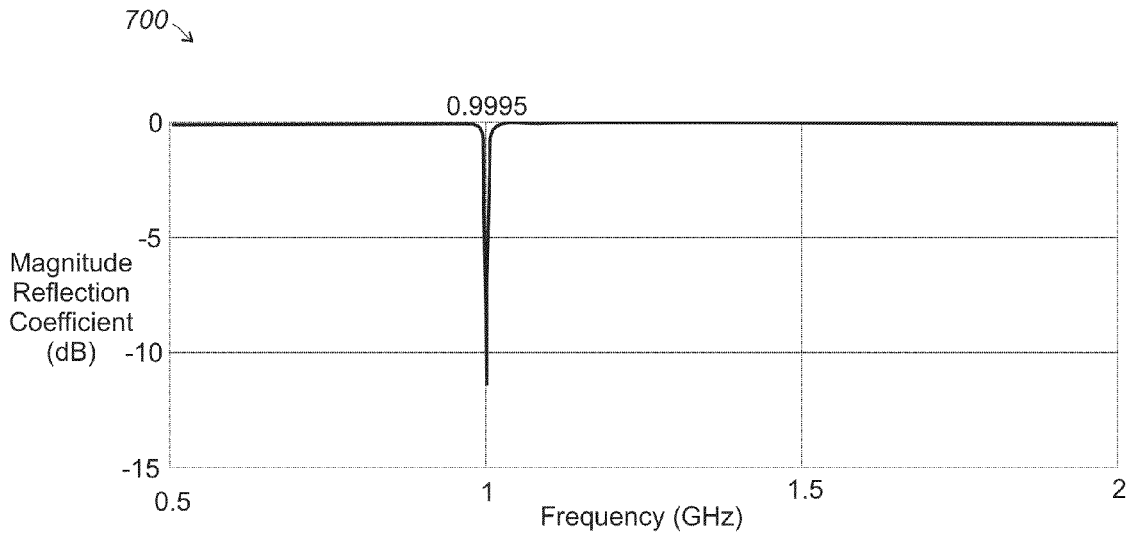
FIG. 7 shows a graph of the magnitude of the reflection coefficient for an embodiment of the antenna system of FIG. 6 with switches closed on all of the arms at a frequency of 0.9995 GHz.

FIG. 7 shows a graph 700 of the magnitude of the reflection coefficient for an embodiment of a twelve arm configuration of antenna system 100 at a frequency of 0.9995 GHz with all switches closed. The magnitude of the reflection coefficient is a significant indicator of antenna efficiency and provides a measurement of the magnitude of signal being reflected back at the 50 ohm input feed point. Typically, a viable antenna design has a magnitude of return loss less than −10 dB and graph 700 shows antenna system 100 meets this criteria.

What is claimed:

1. An electrically small antenna system comprising:

a first plurality of helical arms extending in one direction from a central portion of the antenna;

a second plurality of helical arms extending from the central portion in a direction opposite from the direction of the first plurality of helical arms; and a plurality of switches coupled to control signal transmission and reception on the helical arms, each of the plurality of switches is coupled between a corresponding one of the first plurality of helical arms and the second plurality of helical arms.

2. The antenna system of claim 1, further comprising first and second circular end portions, one end of the first helical arms is coupled to the first circular end portion and one end of the second helical arms is coupled to the second circular end portion.

3. The antenna system of claim 2, wherein the first and second circular end portions raise a resonant feed resistance of the antenna system.

4. The antenna system of claim 1, wherein the switches are coupled at the central portion between one of the first helical arms and a corresponding one of the second helical arms.

5. The antenna system of claim 1, wherein one of the first helical arms and one of the second helical arms are coupled to an electrical power feed.

6. The antenna system of claim 1, further comprising a cylindrical shell around the outer periphery of the helical arms.

7. The antenna system of claim 1, further comprising an automated controller coupled to open and close the switches independently of one another.

8. The antenna system of claim 1, wherein the helical arms form a hollow cylinder; and wherein the switches are spaced around the circumference of a central portion of the cylinder.

9. The antenna system of claim 8, further comprising:

an electronics module coupled in the hollow cylinder that includes the automated controller and a transceiver processor.

10. The antenna system of claim 1, wherein the antenna includes eight pairs of helical arms and seven switches, and operates over frequencies ranging from approximately 1.0025 GHz with all of the switches closed to 1.0235 G HZ with four of the switches closed.

11. The antenna system of claim 1, wherein the antenna includes twelve pairs of helical arms and eleven switches, and operates over frequencies ranging from approximately 0.9995 GHz with all of the switches closed to 1.0745 G HZ with four of the switches closed.

12. The antenna system of claim 1, wherein the antenna has a maximum 11 (eleven) millimeter external diameter, and a maximum 26 millimeter length.

13. The antenna system of claim 1, further comprising an automated controller including logic instructions on computer readable media configured to change transmit and receive frequencies across multiple frequency bands by changing the switches that are open and closed.

14. The antenna system of claim 13, wherein the antenna operates over frequencies greater than approximately 0.9995 GigaHertz and less than 1.0745 GigaHertz.

15. The antenna system of claim 1, wherein different combinations of the switches correspond to different frequencies.

16. The antenna system of claim 1, wherein the plurality of switches comprise micro-electrical-mechanical systems.

17. The antenna system of claim 1, wherein the first plurality of helical arms and the second plurality of helical arms turn approximately 2.5 times along a length of the helical arms.

18. The antenna system of claim 1, wherein the first plurality of helical arms and the second plurality of helical arms acts as inductive coils to cancel a capacitive resistance of the antenna system.

* * * * *

UNITED STATES PATENT AND TRADEMARK OFFICE

CERTIFICATE OF CORRECTION

PATENT NO. : 8,378,920 B2
APPLICATION NO. : 12/542674
DATED : February 19, 2013
INVENTOR(S) : Kurt L. Shlager et al.

It is certified that error appears in the above-identified patent and that said Letters Patent is hereby corrected as shown below:

ON THE TITLE PAGE:

In the "OTHER PUBLICATIONS"

Change "Steven R. Sest" to --Steven R. Best--.

Signed and Sealed this
Sixth Day of May, 2014

Michelle K. Lee

Michelle K. Lee
*Deputy Director of the United States Patent and Trademark Office*